US006748889B2

(12) United States Patent
Martelli et al.

(10) Patent No.: US 6,748,889 B2
(45) Date of Patent: Jun. 15, 2004

(54) SEWING MACHINE PRESSURE FOOT ASSEMBLY FOR QUILT DESIGNS

(76) Inventors: John D. Martelli, 321 S. 61st Ave., Pensacola, FL (US) 32506; Sandra F. Chandler, 2200 Fiesta, Newport Beach, CA (US) 92660

( * ) Notice: Subject to any disclaimer, the term of this patent is extended or adjusted under 35 U.S.C. 154(b) by 0 days.

(21) Appl. No.: 10/254,718

(22) Filed: Sep. 26, 2002

(65) Prior Publication Data

US 2004/0060494 A1 Apr. 1, 2004

(51) Int. Cl.[7] ..... D05B 29/10
(52) U.S. Cl. ..... 112/235
(58) Field of Search ..... 112/150, 235, 112/236, 240, 320, 60

(56) References Cited

U.S. PATENT DOCUMENTS 321,304 A * 6/1885 Lancaster ..... 112/235
1,864,452 A * 6/1932 Lutz ..... 112/470.17
3,094,089 A * 6/1963 Shuman ..... 112/235
4,729,329 A * 3/1988 Leclaire ..... 112/272
5,050,514 A * 9/1991 Niederkorn ..... 112/235
5,054,407 A * 10/1991 Rowley ..... 112/235
5,632,213 A * 5/1997 Ko ..... 112/235
5,676,075 A * 10/1997 Chen ..... 112/240

* cited by examiner

*Primary Examiner*—Ismael Izaguirre
(74) *Attorney, Agent, or Firm*—George A. Bode; Lisa D. Velez; Bode & Associates

(57) ABSTRACT

A pressure foot assembly for minimizing puckering or bunching of quilt or fabric when being sewn or during other contour sewing. The assembly includes a non-rotating or non-walking pressure foot that has a laterally displaced inner foot from the inner feed dog of the machine. The assembly may include a rotating or "walking" pressure foot recessed under the base and outer pressure foot. The assembly includes a cloth guide to laterally limit the movement of the fabric in the direction of the inner foot.

11 Claims, 7 Drawing Sheets

FIG. 7
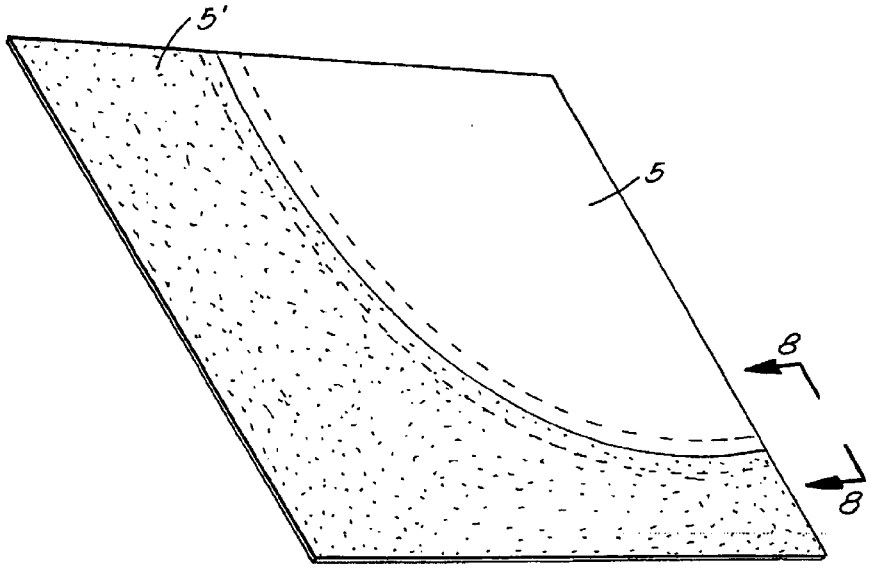
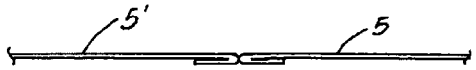
FIG. 8

SEWING MACHINE PRESSURE FOOT ASSEMBLY FOR QUILT DESIGNS

BACKGROUND OF THE INVENTION

1. Field of the Invention

The present invention relates to sewing machine pressure foots (a.k.a. "presser foots") and, more particularly, to a sewing machine pressure foot assembly constructed to minimize, if not eliminate, puckering or bunching of fabric during contour or quilt sewing.

2. General Background

A conventional pressure or presser foot includes a base mountable to a conventional sewing machine, a pair of spaced-apart parallel "skis" to keep constant downward pressure on the cloth item from above so that the cloth item can be pulled evenly through the skis by two motorized feed teeth or feed wheels (hereinafter referred to as "feed dogs").

In operation, the needle moves up and down between the skis and the feed dogs. However, in sewing curved quilt designs and other curved items, the cloth item is often bulky and does not move evenly causing puckering and bunching of the fabrics. The puckering and bunching is most problematic when sewing corners and curved lines or designs of the quilt or fabrics.

Several devices have been patented which attempt to aid in the sewing of contoured lines or eliminate puckering.

U.S. Pat. No. 3,871,306, entitled "FEED CONTROL," U.S. Pat. No. 3,965,832, entitled "METHOD OF CONTOUR SEWING" and U.S. Pat. No. 4,024,825, entitled "SEWING MACHINE WORK SUPPORT AND FEED CONTROL," all related and issued to Wolverine World Wide, Inc., of Rockford, Mich., on the applications of R. B. Egtvedt, et al., disclose, an apparatus for use on a conventional sewing machine that employs a walking pressure foot and non-walking pressure foot that allow contour sewing.

U.S. Pat. No. 5,335,612 issued to Pathold Investments Company Limited, on the application of J. Cizek, et al., entitled "ANTI-PUCKER PRESSURE FOOT," discloses, an anti-pucker pressure foot for a sewing machine comprising: a reciprocating lower feed-dog which engages the lower layer of the material and a first upper pressure foot which overlies the feed-dog and urges the upper layer and lower layer of material towards the feed-dog. A retarding surface upon which the lower layer is urged by a second pressure foot to equalize tension upstream between layers.

U.S. Pat. No. 5,370,072 issued to Union Special Corporation, of Huntley, Ill., on the application of M. Adamski, Jr., entitled "AUTOMATIC ALIGNMENT OF MATERIAL AND POSITIONING AT THE STITCH FORMING LOCATION," discloses a dual-wheel alignment device for a sewing machine that positions the material at the stitch forming location.

Other patents related to pressure or presser foots include: U.S. Pat. No. 4,359,955, entitled "DETACHABLE PRESSURE FOOT"; U.S. Pat. No. 4,069,780, entitled "SEWING MACHINE WITH MEANS FOR STITCHING SLIDE FASTENER STRINGERS ONTO A RELATIVELY THICK ARTICLE"; and, U.S. Pat. No. 6,332,414, entitled "SEWING MACHINE ACCESSORY," all of which disclose various pressure foot designs.

As will be seen more fully below, the present invention is substantially different in structure, methodology and approach from that of prior pressure foot devices.

SUMMARY OF THE PRESENT INVENTION

The preferred embodiment of the pressure foot assembly of the present invention solves the aforementioned problems in a straight forward and simple manner.

Broadly, the present invention contemplates a pressure foot assembly for use with a conventional sewing machine comprising: a base adapted to be mounted to a mount of the sewing machine. The assembly includes a pair of non-walking parallel inner and outer feet, the outer foot being substantially aligned with an outer feed dog of the machine and an inner foot laterally displaced from the outer foot and the inner feed dog of said machine.

The present invention further contemplates a pressure foot assembly having a cloth guide radiating from the inner foot inward in the direction of the outer foot.

The present invention further contemplates a pressure foot assembly having a walking pressure foot recessed under the base and the outer foot to apply pressure to the fabric in the proximity of the outer feed dog of the machine.

In view of the above, an object of the present invention is to provide a pressure foot assembly that minimized, if not eliminates, puckering or bunching when sewing quilts/fabrics with curves and corners.

Another object of the present invention is to provide a pressure foot assembly that includes a cloth guide that provides a lateral limit to the movement of the fabric in the direction of the inner foot.

A further object of the present invention is to provide a pressure foot assembly that includes a cloth guide that provides a seam width measuring tool.

In view of the above, a feature of the present invention is to provide a pressure foot assembly that is simple to use.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 7 illustrates the sewn quilt;

FIG. 8 illustrates a cross sectional view along the plane 8—8 of FIG. 7;

DETAILED DESCRIPTION OF THE PREFERRED EMBODIMENT

Figure 1:
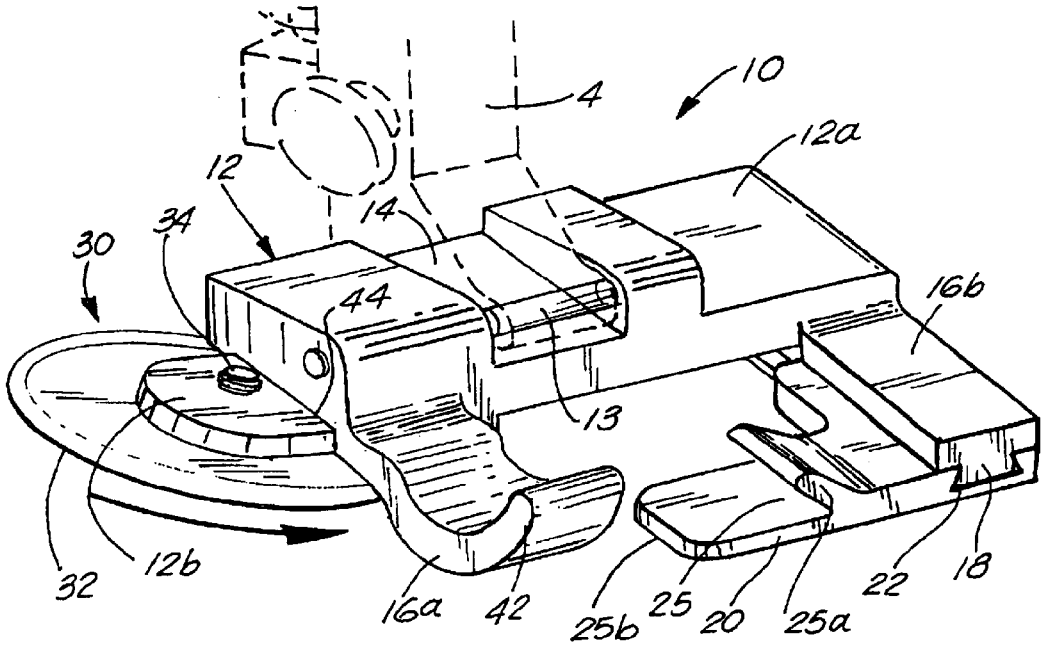
FIG. 1 illustrates a perspective view of the pressure foot assembly of the present invention with the machine's foot lifting arm shown in phantom.
Figure 2:
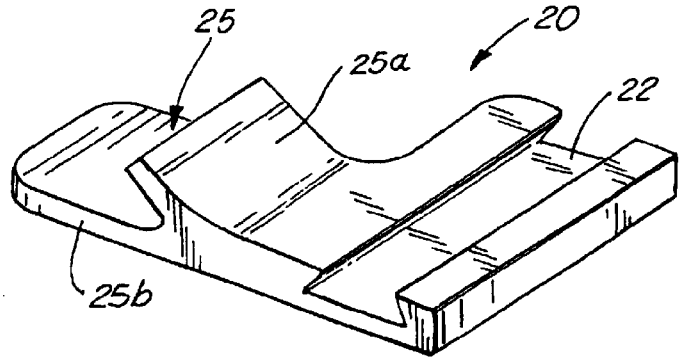
FIG. 2 illustrates a perspective view of the removable cloth guide of the embodiment of FIG. 1.

Referring now to the drawings and in particular FIGS. 1–4 and 6, the pressure foot assembly (or presser foot assembly) of the present invention is generally referenced by the numeral 10. The pressure foot assembly 10 is comprised of a base 12 mountable to a conventional sewing machine via the machine's foot lifting arm 4. The base 12 is mounted by pin 13 through mounting aperture 14. Accordingly, in operation, the machine's foot lifting arm 4 can lift the pressure foot assembly in a conventional manner in order to lift or remove the applied pressure from fabric 5.

Integrated with the base 12 is a pair of spaced-apart parallel feet 16*a*, 16*b*.

Conventionally, pressure feet keep constant downward pressure on the cloth item from above so that the cloth item can be pulled evenly under the feet by a pair of feed dogs (with respect to invention 10, only one such feed dog—outer feed dog 66 which is shown (IN PHANTOM) in FIG. 4 as the other has been made ineffective by displacing inner foot 16*b* as will be discussed further herein). The conventional feed dogs are underneath the lower cloth item and mate and engage with the feet through the upper and lower cloth items, as the needle 2 moves up and down between feet and the feed dogs. Furthermore, the conventional feet design are called "skis" because of their front-end contour. Alternately, the pressure foot itself sometimes is referred to as a sleigh. In the exemplary embodiment, the outer foot 16*a* has the traditional "ski" contour. Accordingly, the outer foot 16*a* will sometimes be referred to as the "outer ski."

The inner foot 16*b* is laterally displaced away from its formerly underlying inner feed dog (NOT SHOWN) in order to accommodate for a cloth guide 20 between the two parallel feet 16*a* and 16*b* and cavity 70 ensures that the underlying or inner feed dog (NOT SHOWN) does not engage the fabric 5. Furthermore, the inner foot 16*b* differs from the conventional ski design in that the forward end is not upwardly curved. Instead, the forward end of the outer foot includes the cloth guide 20.

Because the inner foot 16*b* is laterally displaced, base 12 is laterally extended by extension section 12*a*. having a length of such lateral displacement.

Figure 3:
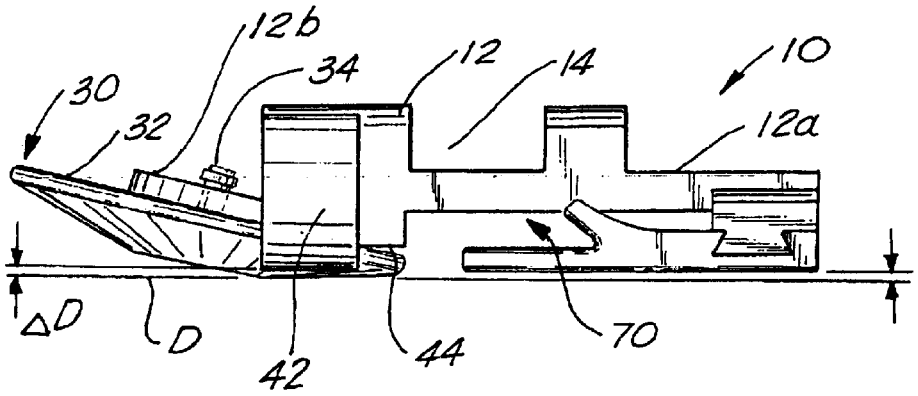
FIG. 3 illustrates a front end view of the pressure foot assembly of the embodiment of FIG. 1.

As best seen in FIG. 3, in the preferred embodiment, the cloth guide 20 is removably attached from the inner foot 16*b* and radiates essentially perpendicular (laterally inward) from the inner surface of the inner foot 16*b* in the direction of the outer foot 16*a*. The cloth guide 20 connects to the inner foot 16*b* in a tongue and groove arrangement. The inner foot 16*b* has a tongue 18 and the cloth guide 20 has a groove 22.

Figure 4:
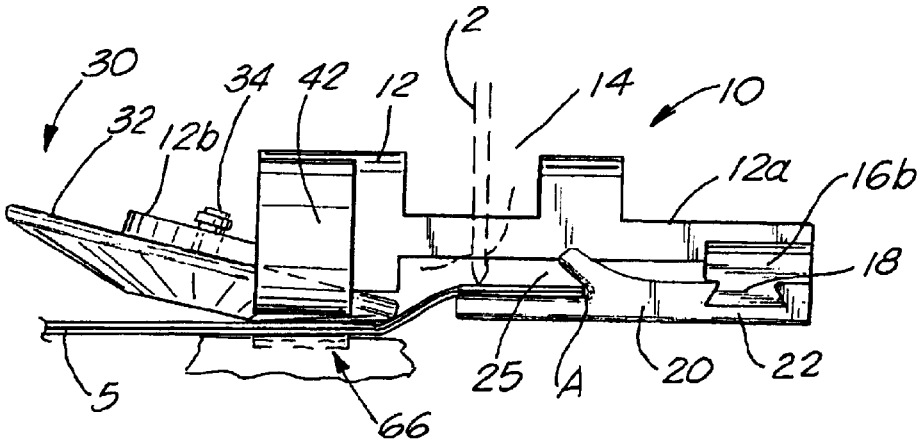
FIG. 4 illustrates the front view of the pressure foot assembly embodiment of FIG. 1 with fabric in the removable cloth guide and a needle, shown in phantom.

The cloth guide 20 has a mouth or channel 25 adapted to receive fabric 5 therein, as best seen in FIG. 4. The mouth or channel 25 limits the movement of the fabric 5 laterally in the direction of inner foot 16*b*. As can be appreciated, the mouth or channel 25 provides a fabric distancing or seam measuring tool so that seams can be straight or of the same width especially when performing contour sewing. For example, the distance from the needle 2 (shown in phantom) to the point A is approximately ¼ of an inch. Nevertheless, other distances may be used to achieve the desired seam. Accordingly, the mouth or channel 25 may be interchanged with others of different sizes for different seam sizes.

The plate in the machine through which the feed dogs project typically includes lines to the right of the outer ski of a conventional pressure foot for establishing the seam width. However, when sewing, the sewer must constantly pull, tug and readjust the fabric so that the seam width remains the same even around curves or corners. This process is cumbersome and oftentimes creates uneven seamlines despite the efforts by the sewer to maintain an even seam because the fabric 5 tends to creep away from the measuring lines since there is nothing to limit or inhibit fabric movement.

The cloth guide 20 of the present invention not only allows for establishing a seam width, but also provides a lateral fabric limiting tool or means which will be made clear from the description immediately below.

The bottom section 25*b* of the mouth or channel 25 is a low profile substrate that allows the fabric 5 to be slid or pulled easily and effortlessly thereover and through the mouth or channel 25. The top section 25*a* of the mouth or channel 25 creates an obtuse angle or opening with respect to the bottom section 25*b* so that the a mouth or channel 25 can accommodate a variety of fabric widths. The interior wall of the mouth or channel 25 limits the lateral movement of the fabric 5 in the direction of the inner foot 16*b*. Thereby, the guiding of the fabric 5 during sewing is made easier to control.

Figure 5:
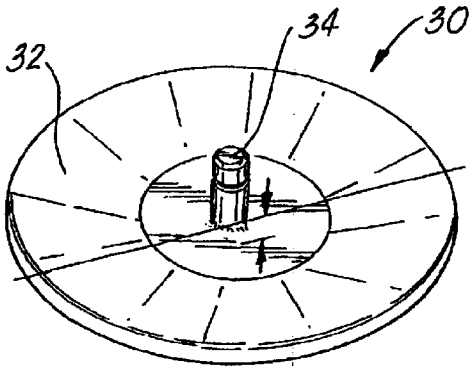
FIG. 5 illustrates a perspective view of the walking pressure foot of the embodiment of FIG. 1.

Referring now to FIGS. 1 and 5, the pressure foot assembly 16 further includes a rotating or "walking" pressure foot 30 angularly mounted to the exterior side of base 12 rearwardly of the outer foot 16*a*. The walking pressure foot 30 includes a concaved disc 32 having a center post 34 affixed thereto for attachment to the connecting tab 12*b*. The exterior surface of the concaved disc 32 applies pressure to the top layer of the fabric 5. The outer feed dog 66 directly under the outer foot 16*a* and concaved disc 32 serves to pull the fabric 5 and 5', as best seen in FIGS. 4 and 6–8.

In the exemplary embodiment, the concavity of the concaved disc 32 is approximately 30° with respect to the horizontal plane or the center axis of disc 32. The angled concaved outer surface of disc 32 directly applies pressure to the fabric 5. Simultaneously, the disc 32 freely rotates to enable easy pivoting of the fabric 5 such as when sewing around corners, curves or other contours. Thereby, puckering or bunching of the fabric 5 (as corners, curves and other contours are sewn) is minimized, if not eliminated.

The angled orientation of the concaved outer surface of disc 32 allows the rotating or "walking" pressure foot 30 to apply pressure to the fabric 5 in an area directly over the outer,feed dog 66. Hence, the walking pressure foot 30 does not apply a 360° rotating feed force to the top of fabric 5.

The base 12 includes a connection tab 12*b* which radiate from the exterior side of base 12. The connection tab 12*b* has formed therein a center hole for connection to the center post 34.

Referring now to FIG. 1, the outer foot 16*a* includes a forwardly curved front end 42. However, part of the underside of the base 12 directly rearward of the outer foot 16*a* and the underside of the rear-end of the outer foot 16*a* adjacent to the base 12 have been trimmed to form a cavity or recess 44 to accommodate for at least a portion of the disc 32 of rotating or "walking" pressure foot 30. The angular mounting of the disc 32 orients a portion of the disc 32 in the cavity or recess 44 so that the concaved outer surface of the disc 32 is substantially horizontal at a predetermined depth D under base 12 and outer foot 16*a*. Thereby, the walking pressure foot 30 can apply the necessary pressure to the top of the fabric 5 directly under the base 12 and maintain a relatively balanced pressure foot assembly 10.

Referring again to FIG. 3, in the preferred embodiment, the underside of forward end of the outer foot 16*a* is slightly elevated a displacement distance ΔD above the depth D.

Figure 6:
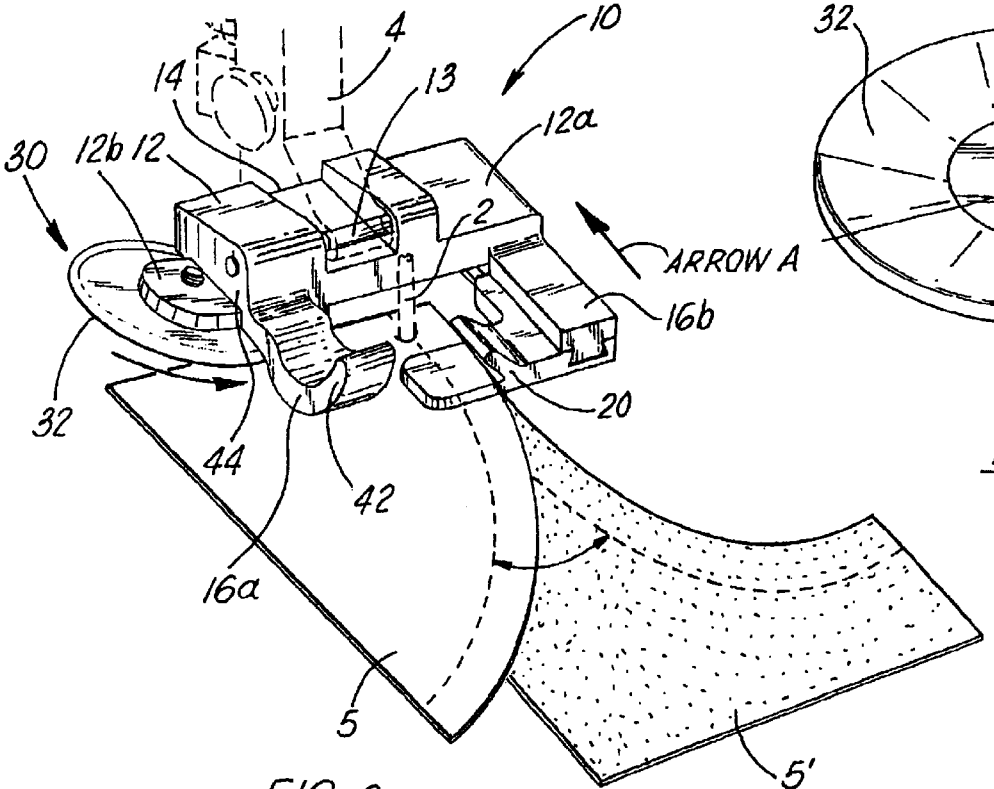
FIG. 6 illustrates a perspective view of the pressure foot assembly of the embodiment of FIG. 1 in operation sewing a quilt.

Referring now to FIGS. 4 and 6,in operation, the pressure foot assembly 10 is adapted to be mounted to a conventional sewing machine and with only the outer foot 16*a* positioned over outer feed dog 66. The inner foot 16*b* is repositioned laterally to the right to no longer be in engagement with the other (inner) feed dog (NOT SHOWN). As the top and bottom layers of fabric 5 and 5' are pulled in the direction of ARROW A by the one feed dog—outer feed dog 66, the cloth-guide 20 and walking pressure foot 30 guide the quilting members or fabric 5 and 5' to be stitched evenly. The walking pressure foot 30 is positioned at or near the outer feed dog 66 of the machine. Since the outer foot 16*a* is slightly elevated above the depth D of disc 32, the outer foot 16*a* applies little, if any pressure to the quilting members or fabric 5 and 5'. In other words, the primary source of pressure to the top layer of fabric 5 and 5' above the outer feed dog 66 is applied by the walking pressure foot 30.

Figure 9A:
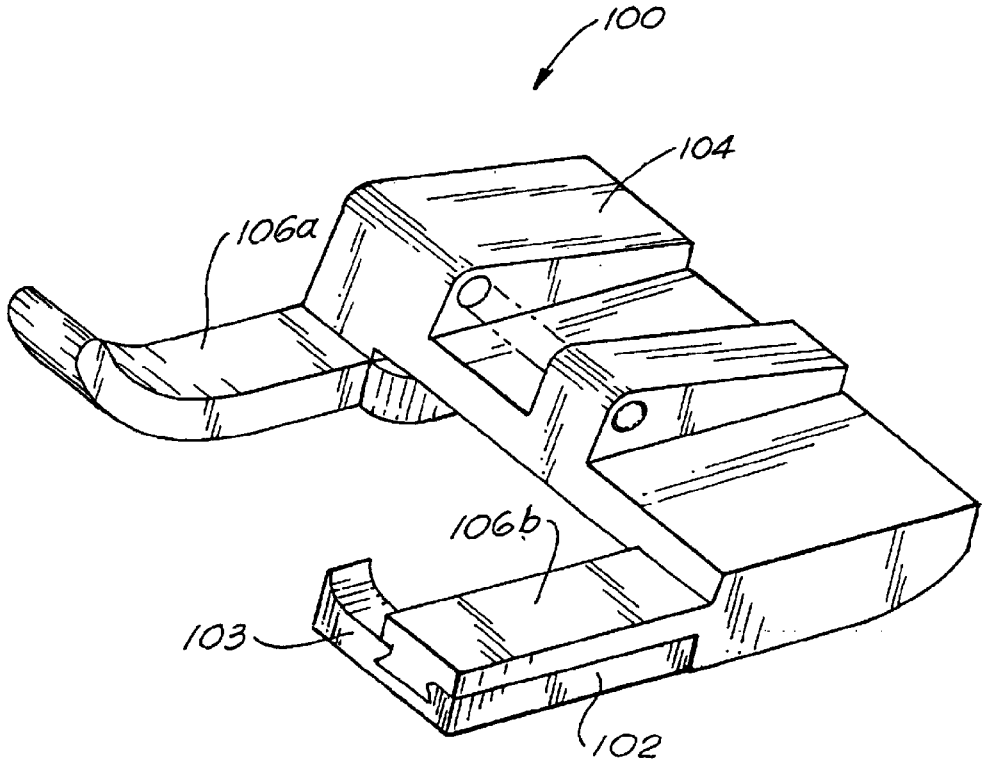
FIG. 9A illustrates a perspective view of a second embodiment of the pressure foot assembly of the present invention.

Referring now to FIG. 9A, a second embodiment of the pressure foot assembly 100 is as shown. The embodiment of FIG. 9A includes a different cloth guide 102. Cloth guide 102 includes a stop projection 103 which has a free distal end that slightly flares. The stop projection 103 extends inwardly in the direction of outer foot 106*a* and can also serve as a distancing or seam measuring tool. Unlike the cloth guide 20, cloth guide 102 is affixed to the outer foot 106*b*.

Furthermore, rotating or "walking" pressure foot 30 has been omitted. Therefore, the outer foot 106*a* would apply pressure to the fabric 5. Accordingly, the outer foot 106*a* and base 104 are not trimmed or elevated in the manner as previously described to accommodate rotating pressure foot 30.

Figure 9B:
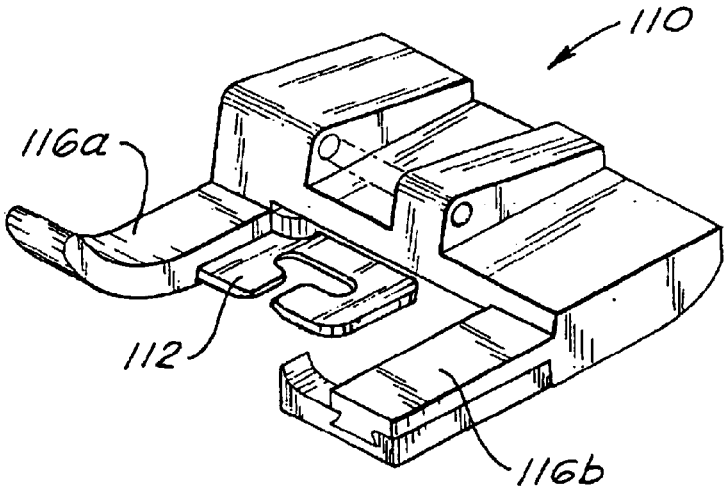
FIG. 9B illustrates a perspective view of an alternate embodiment of the pressure foot assembly of the embodiment of FIG. 9A.

Referring now to FIG. 9B, an alternate embodiment to the second embodiment of the pressure foot assembly 110 of FIG. 9A is illustrated. The pressure foot assembly 110 differs from the embodiment of FIG. 9B in that a needle and thread slot member 112 has been added to extend from the outer foot 116*a*. Most parallel ski pairs are contoured to include a needle and thread slot therebetween. However, the distance between the outer and inner feet 116*a* and 116*b* has been increased as the result of the displacement of the inner foot 116*b*. The a needle and thread slot member 112 is positioned at a location to accommodate the alignment of the needle on the machine.

While not shown, the needle and thread slot member 112 can be included in the embodiment of FIG. 1.

Figure 10B:
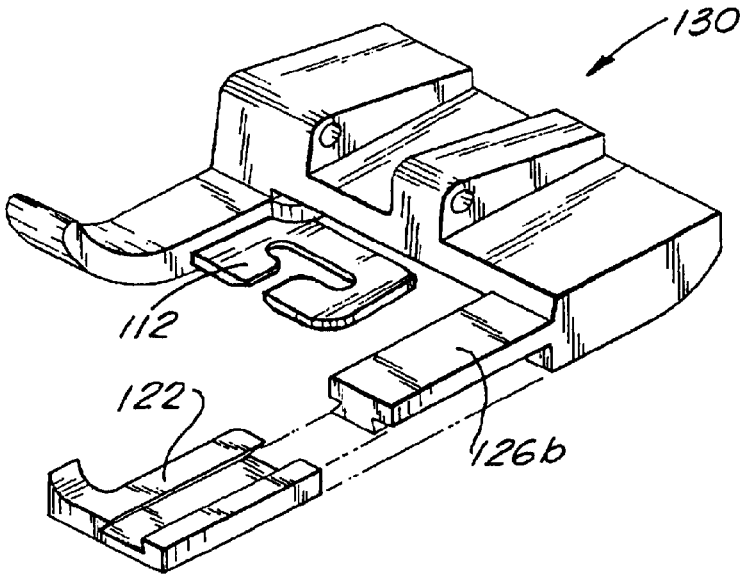
FIG. 10A illustrates a perspective view of a third embodiment of the pressure foot assembly of the present invention; and, FIG. 10B illustrates a perspective view of an alternate embodiment of the pressure foot assembly of the embodiment of FIG. 10A.
Figure 10A:
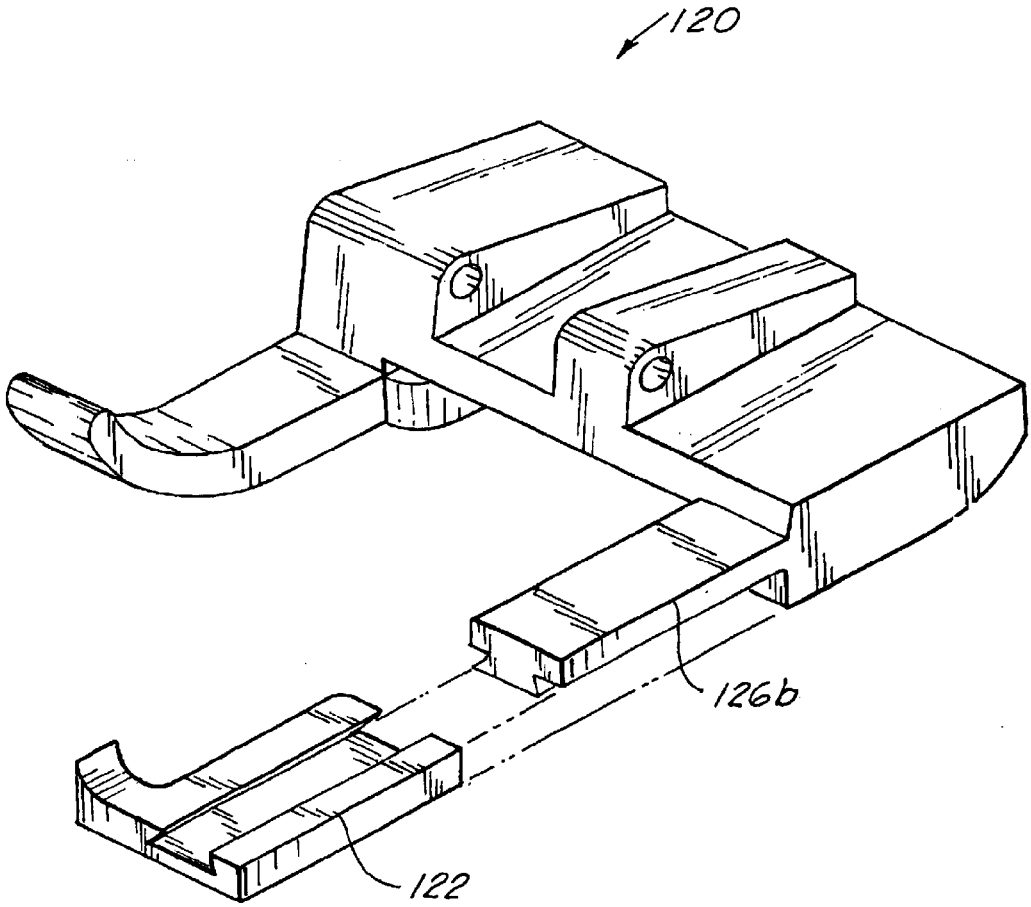

Referring now to FIGS. 10A and 10B, a third embodiment and an alternate version of the third embodiments are shown. In general, pressure foot assembly 120 and pressure foot assembly 130 differ from pressure foot assemblies 100 and 110 of FIGS. 9A and 9B in that the cloth guide 122 is removably coupled to the inner foot 126*b* via a tongue and groove arrangement.

Moreover, the cloth guide 20 may be substituted with the embodiments of FIGS. 10A and 10B as well.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pressure foot assembly for use with a conventional sewing machine comprising:

a base adapted to be mounted to a mount of the sewing machine;

a pair of non-walking parallel inner and outer feet, the outer foot being substantially aligned with an outer feed dog of the machine and an inner foot laterally displaced from the outer foot and the inner feed dog of said machine;

a removable cloth guide radiating from the inner foot inward in the direction of the outer foot, said cloth guide comprising a mouth having a bottom section and a top section, said mouth adapted to receive therethrough fabric; and, a walking pressure foot disposed rearward of said outer foot and under said base and above said outer feed dog.

2. The assembly of claim 1, wherein said outer foot is a ski-shaped foot.

3. The assembly of claim 1, wherein said walking pressure foot comprises:

a concaved disc angularly mounted to a side of the base, said concaved disc is adapted to freely rotate and has a concaved outer surface oriented under said base to apply pressure to fabric.

4. The assembly of claim 1, further comprising:

a needle and thread slot member aligned with a needle of said machine.

5. The assembly of claim 1, wherein the cloth guide comprises:

a stop projection radially extending from the inner surface of said inner foot.

6. The assembly of claim 1, wherein the cloth guide limits lateral movement of fabric in the direction of said inner foot and provides a seam width measurement tool.

7. A pressure foot assembly for use with a conventional sewing machine comprising:

a base adapted to be mounted to a mount of the sewing machine;

a pair of non-walking parallel inner and outer feet, the outer foot being substantially aligned with an outer feed dog of the machine and an inner foot laterally displaced from the outer foot and the inner feed dog of said machine;

a walking pressure foot disposed rearward of said outer foot and under said base and above said outer feed dog; and, a removable cloth guide radiating from the inner foot inward in the direction of the outer foot and limiting lateral movement of fabric in the direction of said inner foot and provide a seam width measurement tool, said cloth guide comprising a mouth having a bottom section and a top section, said mouth adapted to receive therethrough fabric.

8. The assembly of claim 7, wherein said outer foot is a ski-shaped foot.

9. The assembly of claim 7, wherein the cloth guide comprises:

a stop projection radially extending from the inner surface of said inner foot.

10. The assembly of claim 7, wherein said walking pressure foot comprises:

a concaved disc angularly mounted to a side of the base, said concaved disc is adapted to freely rotate and has a concaved outer surface oriented under said base to apply pressure to fabric.

11. The assembly of claim 7, further comprising:

a needle and thread slot member aligned with a needle of said machine.

* * * * *